US005125539A

United States Patent [19]

Schneider

[11] Patent Number: 5,125,539

[45] Date of Patent: Jun. 30, 1992

[54] REGULABLE-FLOW DISPENSER OF A PASTY PRODUCT MIXED WITH A SECONDARY PASTY PRODUCT AND THE USE OF SUCH A DISPENSER

[75] Inventor: Bernard Schneider, Sainte-Menehould, France

[73] Assignee: Cebal, Clichy, France

[21] Appl. No.: 669,008

[22] Filed: Mar. 13, 1991

[30] Foreign Application Priority Data

Mar. 14, 1990 [FR] France ..... 90 03847

[51] Int. Cl.[5] ..... B65D 37/00

[52] U.S. Cl. ..... 222/144.5; 222/145; 222/207; 222/209; 222/213; 222/256; 222/378; 222/383; 222/389; 417/479

[58] Field of Search ..... 222/94, 129, 136, 144.5, 222/145, 207, 209, 213, 256, 257, 258, 260, 378, 380, 386, 389

[56] References Cited

U.S. PATENT DOCUMENTS 4,962,870 10/1990 Schneider ..... 222/209
4,964,541 10/1990 Gueret ..... 222/144.5
4,967,937 11/1990 von Schuckmann ..... 222/136
4,978,037 12/1990 Shuckmann ..... 222/260
4,979,646 12/1990 Andris ..... 222/136

FOREIGN PATENT DOCUMENTS 340724 11/1989 European Pat. Off. .
345458 12/1989 European Pat. Off. .
277893 7/1990 European Pat. Off. .
8802173 7/1989 Fed. Rep. of Germany .

*Primary Examiner*—Michael S. Huppert
*Assistant Examiner*—Philippe Derakshani
*Attorney, Agent, or Firm*—Dennison, Meserole, Pollack & Scheiner

[57] ABSTRACT

A pasty product dispenser (1) comprising a body defining a chamber for storing at least one main pasty product and pumping system defined by a wall surmounting the storage chamber and by an intake valve member, the wall carrying on the side of the storage chamber a separator tube enclosing the valve member and comprising passages for at least one secondary pasty product contained between the separator tube and the body, the passages being outside the separator tube, the wall having a rotating cover with traversing apertures, rotation of the cover progressively masks or exposes the passages, the apertures being occluded by the valve member when it is in its low position.

14 Claims, 2 Drawing Sheets

REGULABLE-FLOW DISPENSER OF A PASTY PRODUCT MIXED WITH A SECONDARY PASTY PRODUCT AND THE USE OF SUCH A DISPENSER

The invention relates to a dispenser of pasty product incorporating a pumping system, and to its use.

The Applicants' Patent Application EP-A-0277893 disclosed a pasty product dispenser comprising a body defining a chamber for storing the pasty product and a compression chamber defined by a wall surmounting this storage chamber, an inlet valve comprising a valve member which slides in a central orifice in the said wall and it has a rim which bears in sealing-tight fashion on this wall and a valve for discharging pasty product to the dispensing orifice or orifices.

In this dispenser the pasty product from the storage chamber is supported by a piston which slides in the body in a manner which is sealing-tight in respect of the pasty product. Such a dispenser makes it possible to deliver measured quantities of a paste strip, complete forward movement of its actuator and its return, typically flexible, controlling a cycle of dispensing and pumping the pasty product. It does not make it possible to obtain a paste strip with stripes.

Furthermore, there is known from Patent Application EP-A-0345458, U.S. Pat. No. 4,967,937, a pasty product dispenser which comprises a body defining a storage chamber for at least one main pasty product and a pumping system defined by a wall surmounting this storage chamber and by an inlet valve, the valve comprising in an orifice in the wall and having a valve member with a rim which bears in sealing-tight fashion on this wall in the low position of the valve member, the wall carrying on the storage chamber a separator tube enclosing the said valve member and having top and bottom ends which are open and also orifices for passage of a secondary product contained in the annular space comprised between the separating tube and the body.

This wall has a frustoconical returned edge which forms the bottom of the pumping chamber. There is no compression chamber. This dispenser makes it possible to obtain a strip of pasty product which has coloured stripes of a secondary product.

The Applicants have addressed the problem of dispensing a pasty strip in reproducible and regulable quantities containing at least one secondary product, this secondary product being visible in or on the paste strip.

This condition of visibility would indeed make it possible either to recognize the product dispensed or to use this heterogeneous distribution of the secondary product in the pasty product being dispensed in order to make sure that there is sufficient work of the paste after its application, this work, for example massage, being translated into an homogenization of the colour of the paste which is thus worked.

A "paste" or "pasty product" also denotes a thick creme.

DISCLOSURE OF THE INVENTION

As known from EP-A-0345458, the object of the invention is a dispenser of pasty product comprising a body defining a chamber for storing at least one main pasty product and a pumping system defined by a wall surmounting the storage chamber and by an inlet valve member, the valve member sliding in a typically central orifice in the wall and having a rim which bears in sealing-tight fashion on the wall in the low position of the valve member, the wall carrying on the same side as the storage chamber a separator tube enclosing the valve member and having an open lower end and orifices to the pumping chamber for at least one secondary pasty product contained between the separator tube and the body, the orifices being outside the separator tube.

According to the invention, in order to render regulable the quantity or quantities of secondary product or products delivered at each intake phase and therefore at each application of pressure to the actuator, the fixed wall surmounting the actuator, the wall which carries both the separator tube and the through-ways, is provided with a rotating cover carrying traversing apertures, rotation of the cover progressively masking or exposing the orifices in the fixed wall, the valve member then moving into its low position to occlude these traversing apertures whatever their position may be.

Generally speaking, the rotating cover and the wall are in contact via surfaces of revolution about one and the same axis, for example the longitudinal axis of the dispenser. These surfaces of revolution may be planes at right-angles to the axis. The same applies to the contacting surfaces of the cover and of the inlet valve member in the low position. Thus, preferably, the top of the rotating cover comprises a flat surface surrounding the typically central aperture for the intake of main pasty product into the pumping or compression chamber, and this flat surface constitutes the seat of the inlet valve, the bottom of the run of the valve member being applied in fluid-tight manner to the surface when the valve member is in the closed position, that is to say when the pumping or compression chamber has its volume reduced by application of the actuator. Construction is simplified when the contacting surfaces of the wall and of the cover on the one hand and of the cover and the valve member in the low position on the other are flat and parallel with each other.

The traversing apertures then typically open out onto the same flat surface of the cover, the underside of the rim of the valve member being flat from the circumference of the central orifice at least as far as the outside of the upper ends of these apertures.

The orifices which are extended by the traversing apertures are used as apertures through which at least one secondary paste product contained in all or part of the annular space comprised between the separator tube and the body can pass. When the inlet valve rises, the main pasty product is drawing in through the valve member and the central orifice while the secondary product is drawn directly into the compression chamber by the aperture or apertures which surmount it.

Successive induction movements bring about a reduction in the quantity of secondary product in its annular segmental peripheral storage gap, the rise of this product then being accompanied by a rise of the main pasty product.

It was found that the pasty strips delivered had a reproducible marbled aspect, the coloured secondary product being introduced itself into the principle product in reproducible quantities from one depression of the actuator to another, and passage through the compression chamber and through the expulsion incorporating the secondary product into the main product which is of a viscosity which is normally close to that of the main product but which is not readily miscible there-with without effecting an intensive homogenization or mixing process.

The problem posed is therefore indeed resolved by the dispenser according to the invention. The reproducible mixed paste strips in which the secondary product or products is or are still visible are obtained with effect from the second pressure of the actuator and the quantity or quantities of secondary product or products delivered at each stroke and therefore at each application of pressure to the actuator is or are regulable.

The rotating cover may be guided in its rotation by the cooperation of two circular relief members on the said cover and on the fixed wall. The fixed wall and the cover are preferably in sealing-tight contact in order to avoid pasty products infiltrating between their contacting surfaces, infiltrations which would adversely affect the proper functioning of the rotating cover. The circular relief members are preferably carried by these contacting faces, fit one into the other, and for example may be a circular rib which fits into a circular groove.

Adjustment of the quantity of secondary product dispensed into the pasty strips dispensed is preferably accomplished by means of at least one lateral portion projecting from the rotating cover and the position of this cover may make it possible to read a reference to the rate of flow of coloured product. More sensitive adjustment can be achieved by using for the cover annular elongate apertures of variable width.

Furthermore, if the rate of flow setting is altered by rotation of the cover, the new rate at which secondary product is dispensed is obtained with effect from the second depression of the actuator following such a change being implemented.

Reverting to the general situation, the annular gap comprised between the separating tube and the dispenser body and the storage chamber may be divided into a plurality of segments by transverse partitions connecting the tube and the body in order to contain different secondary products within them, each segment being provided with at least one orifice.

Such a structure may be employed for preferred distribution of a secondary product in the paste strip, one or a plurality of segments being occupied by the principal pasty product.

It is particularly interesting to have a pumping system comprising a tubular deformable pumping element defining a compression chamber fixed on the cover above the storage chamber, this element being known per se from the cited document. And it is also interesting to have a discharge valve comprising a flexible disc the periphery of which is so held that it bears on an upper end edge of the deformable element, such a valve being known from publication EP-A-0309367 of the Applicants and sliding against reduced discharge loadings. This publication also describes the inlet valve member of the Examples which follow, the valve member reducing the return time of the actuator when the thickness of the deformable film of the deformable element is sufficiently small.

In accordance with an advantageous form of embodiment, the body of the dispenser is a rigid metal tube which after assembly contains a sliding piston, the bottom end of the tube possible being provided with a foot which allows air to pass underneath the piston, the top of the tube being narrowed into a substantially frustoconical shoulder ending in a rolled edge. The wall surmounting the storage chamber and carrying the inlet valve and the separator tube and the orifices is then preferably fixed on this rolled edge, the wall comprising a lateral peripheral portion on which a circular profiled member is engaged, so closing the deformable tubular element down on the wall in a sealing-tight manner. This circular profiled member may have an outer surface which serves for axial sliding movement of the actuator of the dispenser and another outer surface which is used for fitment of a cap, the said member preferably bearing on the shoulder of the tube facilitating its fitment and improving its stability and therefore the stability of the way it locks the deformable tubular element.

According to this same form of embodiment and in the event of the dispenser comprising a rotating cover for regulating the rate(s) of flow of secondary product(s), it is particularly interesting to use the circular profiled member for clamping the deformable tubular element on the wall as a means for rotating the said rotating cover. For this, the projecting lateral portion of this cover is fitted into a hollow or an aperture in the lateral clamping portion of the profiled member.

To facilitate assembly and to ensure stability of the assembly, the peripheral lateral portion of the wall is extended itself into a shoulder which bears on the shoulder of the tube while the circular profiled member bears directly on the shoulder of the peripheral portion.

The exterior of the circular profiled member can then comprise a discontinuity or notch which makes it possible to read a rate of flow marking carried by the subjacent shoulder, that is to say the shoulder of the tube or the shoulder of the lateral portion of the wall.

These various arrangements which have been described for a metal tube with a frustoconical shoulder apply equally to a case where the wall carrying he separator tube and the traversing apertures according to the invention constitute the top of a rigid dispenser body of a different type, for example one which consists of a plastic material.

In order to obtain a constant concentration of secondary product(s) in the measured doses of dispensed pasty strip, the front shell of the sliding piston with a circular groove which received or provides for fitment of the separator tube enclosing the valve member, the depth of the groove being chosen so that the piston and thereof distribution stops a little before the end of the induction of the secondary product(s), the last discharge of secondary product(s) thus being still at the normal rate of flow.

Additional details will be set forth in the Examples.

ADVANTAGES

The secondary product(s) is or are premixed according to a reproducible structure permitting of a reproducible identification of the blending work.

If there are a plurality of secondary products distributed throughout the different segments of the annular space for storing these products, the mass of each secondary product is constant from one does to another.

It is possible to enjoy an adjustment of the quantity of secondary product(s) introduced into the doses of pasty product and a convenient identification of the quantity or rate of flow. Typically, it is possible thus to vary the relative concentration of secondary product(s) in the pasty strip from 0 to 20%.

Another object of the invention is the use of the aforesaid dispenser for the distribution of a heterogeneously mixed paste consisting of a coloured pasty product, this paste requiring to be blended and the blending work being controlled by homogenization of the paste.

Figure 1:
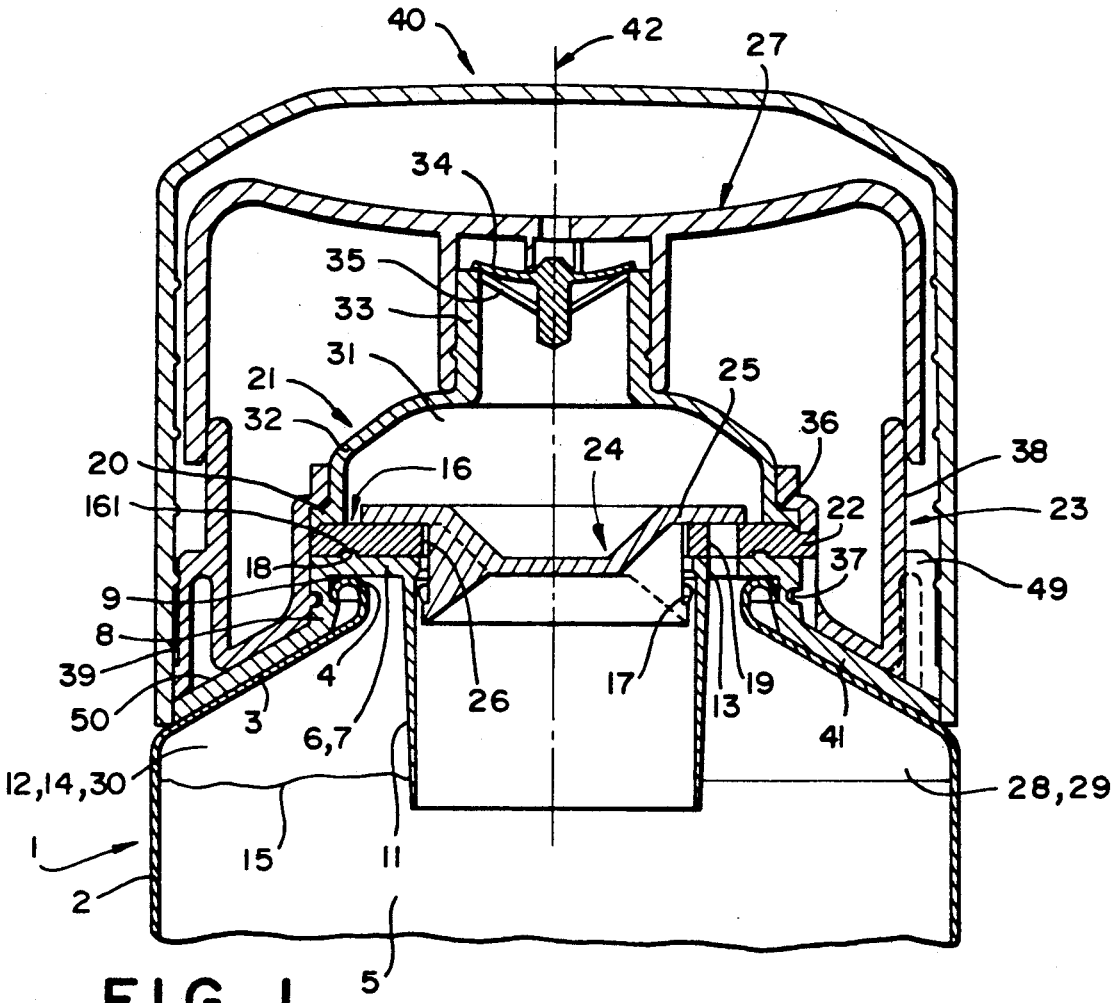
FIG. 1 shows a dispenser according to the invention, in cross-section.

The dispenser 1 in FIG. 1 comprises a rigid tubular body 2 of aluminum, the top end of which has been narrowed to form a frustoconical shoulder 3, ending in a rolled edge 4. The top of the storage chamber 5 is defined by this shoulder 3 and by the horizontal portion 6 of an annular wall 7 of plastics material which also comprises a peripheral lateral portion 8 having an inner groove 9 which is snap-fitted on the end of the rolled edge 4. The under side of the horizontal portion 6 of the wall 7 carries a crown 11 or separator tube 11 which descends a little below the start of the shoulder 3 and defines with the body 2 an annular space 12 which will contain at least one secondary pasty product or "coloured product". The inner surface of the separator tube 11 is spaced 0.5 mm apart from the sealing ring 17 which retains the valve member 24.

The wall 7 or more precisely its horizontal portion 6 carries on the outside and at the base of the separator tube 11 four orifices 13 for passage of coloured product 14, of which the slightly undulating filling level 15 extends a little beyond the bottom of the shoulder 3. These orifices are situated at every 90° and have a diameter of 2.5 mm.

A cover or annular wall 16 is placed on the wall 7, its circular groove 161 fitting onto the circular rib 18 of the top surface of the wall 6 or 7. The cover carries four regularly spaced apart traversing apertures 19.

The cover 16 is able to rotate in relation to the wall 7 and the base 20 of the deformable tubular element 21. It comprises a transverse spur 22 which fits into an aperture in a circular profiled member 23 which is used to entrain it.

The valve member 24 comprises a shell 25 which having a central portion occludes the central intake aperture 26 and a rim which occludes the traversing apertures 19. This valve member 24 functions in the same way with a single wall 7 or with a thickened wall (7+16), the distance between the retaining ring 17 of the valve member 24 and the bottom of the shell 25 at the level of the circumference of the orifice 26 being however increased in the second case the present example.

Tests have shown that the coloured product 14 passed into the paste strip with a reproducible distribution in the direction of its length with effect from the second operation of the actuator 27.

FIG. 1 shows the position of a transverse partition 28 separating two annular segments such as 29 and 30.

The compression chamber 31 of the dispenser 1 comprises the deformable tubular element 21 of which the deformable shell 32 is of a thickness which is limited to 0.8 mm and of which the top neck portion 33 carries a flexible cap 34 connected to the neck portion 33 by three flexible members 35, the cap 34, together with the top end of the neck portion 33, forming the discharge valve. The base 20 of the tubular element 21 is clamped onto the wall 7 by the inner returned edge 36 of the circular profiled member 23 which is snap-fitted into an external groove 37 in the lateral portion 8 of the wall 7, this arrangement making it possible to rotate the profiled member 23, the spur 22 thereon entraining with it the cover 16. The profiled member 23 also comprises an upright tubular portion of which the outer surface 38 serves as an axial guide for the actuator 27, and a descending tubular portion the outer surface 39 of which serves for fitment of the cap 40, subject to a slight forcing action. This member 23 bears on a shoulder-shaped extension 41 of the lateral portion 8 of the wall 7, this extension 41 itself bearing on the shoulder 3 of the tube 2, which facilitates fitment and ensures the stability of the assembly.

The descending tubular portion with the outer surface 39 is discontinuous over 1 cm between two small partitions 49, making it possible to see the flow markings carried on the periphery of the shoulder 41 of the member 7 at the level 50 situated in front of the point at which the member 23 bears on the said shoulder 41.

In a first version, the four traversing apertures 19, centered at the same distance from the main axis of symmetry 42 as the orifices 13, have a diameter of 3 mm, the slight over-diameter in relation to the diameter of the orifices 13 providing for normal intake of pasty product.

Figure 2:
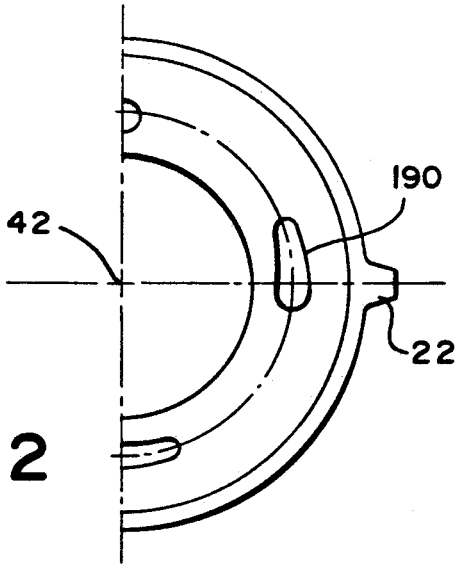
FIG. 2 shows a cover of the dispenser in a half-view from above and with the traversing apertures and FIG. 3 shows the same dispenser but in a complete view and likewise in cross-section.

In a second version (FIG. 2), the traversing apertures 190, still centered in the same way, have a width ranging from 3 mm to 1 mm over a circumferential length of 6 mm, not including the rounded ends, which permits of more sensitive adjustment of the rate(s) of flow of secondary paste product(s).

Figure 3:
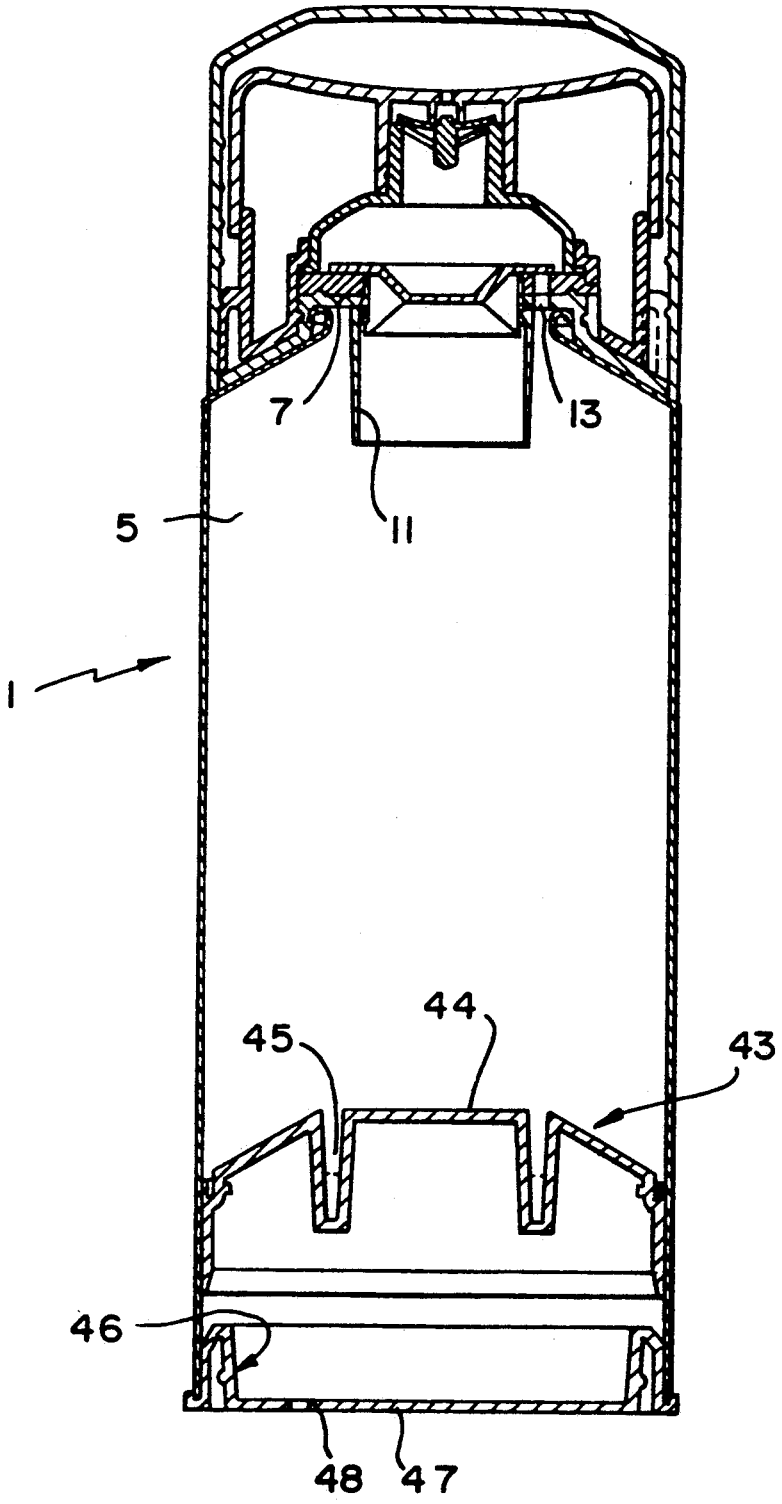

FIG. 3 shows the dispenser 1 in FIG. 1 but complete and more particularly its sliding piston 43 of which the front shell 44 comprises a circular groove 45 providing for fitment or reception of the separator tube 11 and therefore allowing unlimited emptying of the dispenser 1 via the tube 11. The depth of engagement of this groove is so chosen that dispensing ceases before there is a total or partial lack of secondary product in the paste strips being delivered.

The bottom end of the dispenser is fixed on a flexibly fitted base 46, of which the bottom 47 comprises an aperture 48 through which air can pass.

APPLICATIONS OF THE INVENTION

The dispenser according to the invention is used for the packaging of pasty products in the cosmetics, pharmaceutical, paramedical, hygiene and foodstuffs fields and particularly for cases where the products being dispensed have to undergo a blending operation which requires to be monitored.

I claim:

1. A dispenser for pasty products (1) comprising a body (2) defining a storage chamber (5) for at least one principal pasty product and a pumping system (24, 31, 33 and 34) defined by a wall (7) surmounting said storage chamber (5) and by an intake valve member (24), said valve member (24) sliding in an orifice (26) in said wall (7) and having a rim which bears in sealing-tight manner on said wall (7) in the low position of said valve member (24), said wall (7) carrying a separator tube (11) enclosing said valve member (24), said separator tube having an open lower portion, said wall (7) comprising orifices (13) to allow passage of at least one secondary pasty product contained between the separator tube (11) and said body (2), said orifices (13) being outside said separator tube (11), characterized in that said wall (7) is provided with a rotating cover (16) having traversing apertures (19), rotation of said cover (16) progressively masking or exposing said orifices (13) in said wall (7), said apertures (19) being occluded by said valve member (24) when said valve member is in its low position.

2. A dispenser according to claim 1, in which said cover (16) and said valve member (24) have contacting surfaces which in the low position are plane and parallel with one another.

3. A dispenser according to any one of claims 1 or 2, in which said traversing apertures are circumferentially elongate and are of variable width.

4. A dispenser according to any one of claims 1 or 2, in which said cover (16) is guided in its rotation by cooperation of two circular projecting members (18 and 161) on said wall (7) and on said cover (16).

5. A dispenser according to claim 1, of which the body (2) contains a sliding piston (43), the bottom end of the body (2) allowing air to pass, the top of the body (2) comprising a substantially frustoconical shoulder (3).

6. A dispenser according to claim 5 in which said wall (7) surmounting said storage chamber (5) and carrying said separator tube (11) and said orifices (13) comprises a peripheral lateral portion (8) on which a circular profiled member (23) engages, clamping onto said cover (16) in sealing-tight fashion a deformable tubular element (21) defining a compression chamber (31) of said pumping system (24, 31, 33 and 34).

7. A dispenser according to claim 6 in which said circular profiled member (23) bears on the peripheral lateral portion (8) of the wall (7) and has two circular cylindrical surfaces (38, 39) which respectively serve for axial sliding of an actuator (27) which takes the form of a push rod and provides for fitment of a cap (40).

8. A dispenser according to claim 7 in which said cover (16) includes a lateral portion (22) which fits into said circular profiled member (23), said circular profiled member (23) being rotatable for rotation of said cover.

9. A dispenser according to claim 8 in which said circular profiled member (23) has a discontinuous outer portion to reveal flow markings carried by the shoulder (3) of said body or by said peripheral lateral portion (8 and 41) of said wall (7).

10. A dispenser according to any one of claim 1 or 2, in which said separator tube (11) and said body (2) form between them an annular space (12) which is divided into a plurality of segments (29, 30) by partitions connecting said tube (11) and said body (2), each segment being provided with at least one orifice for the passage of secondary product.

11. A dispenser according to any one of claims 5 to 9, the body (2) of which is a metallic tube (2), the top of the tube (2) being narrowed to form said substantially frustoconical shoulder (3) which ends in a rolled edge (4), said wall (7) being fixed on said rolled edge (4).

12. A dispenser according to any one of claims 5 to 8 in which said sliding piston (43) comprises a front shell (44) in which there is a circular groove (45) for reception of the said separator tube (11), the depth of this groove being chosen to avoid a fluctuation in the concentration of secondary product(s) upon completion of distribution.

13. Use of the dispenser according to claim 1 for the distribution of a paste blended from heterogeneous pasty products by a controlled kneading process for homogenization of said paste.

14. A dispenser according to claim 3 in which said separator tube (11) and said body (2) form between them an annular space (12) which is divided into a plurality of segments (29, 30) by partitions connecting said tube (11) and said body (2), each segment being provided with at least one orifice for the passage of secondary product.

* * * * *